United States Patent [19]

Masaki et al.

[11] 4,033,122

[45] July 5, 1977

[54] METHOD OF AND SYSTEM FOR CONTROLLING AIR FUEL RATIOS OF MIXTURES INTO AN INTERNAL COMBUSTION ENGINE

[75] Inventors: Kenji Masaki; Hidehiro Minami, both of Yokohama, Japan

[73] Assignee: Nissan Motor Co., Ltd., Yokohama, Japan

[22] Filed: Oct. 18, 1974

[21] Appl. No.: 516,077

[30] Foreign Application Priority Data

Nov. 8, 1973 Japan ..... 48-125683
Dec. 21, 1973 Japan ..... 48-143297

[52] U.S. Cl. ..... 60/274; 60/282; 60/285; 60/289

[51] Int. Cl.² ..... F02B 75/10

[58] Field of Search ..... 60/274, 285, 301, 289, 60/290, 282

[56] References Cited

UNITED STATES PATENTS

| | | | |
|---|---|---|---|
| 3,708,980 | 1/1973 | Truxell | 60/301 |
| 3,785,153 | 1/1974 | Schwing | 60/305 |
| 3,827,237 | 8/1974 | Linder | 60/285 |
| 3,861,366 | 1/1975 | Masaki | 123/119 R |
| 3,910,240 | 10/1975 | Omori | 60/276 |

*Primary Examiner*—Douglas Hart

[57] ABSTRACT

One-half of combustion chambers is fed with a lean air-fuel mixture the ratio of which is above the ratio at which maximum quantities of $NO_x$ are formed and the other half with a rich mixture the ratio of which is below the ratio at which maximum quantities of $NO_x$ are formed, the rich mixture ratio depending on vehicle speed. Above a predetermined load all chambers are fed with a richer-than-stoichiometric mixture and air may be added to the exhaust.

6 Claims, 8 Drawing Figures

METHOD OF AND SYSTEM FOR CONTROLLING AIR FUEL RATIOS OF MIXTURES INTO AN INTERNAL COMBUSTION ENGINE

The present invention relates in general to a fuel system of an internal combustion engine, and particularly to a fuel supply control system of a spart-ignition internal combustion engine. More particularly, this invention is concerned with a fuel supply control system of a spark-ignition internal combustion engine to selectively feed lean and rich mixtures of high and low air-fuel ratios into the combustion chambers of the internal combustion engine.

With the coming enforcement of the regulations for abatement of the environmental pollution aimed at various industrial installations, the realization or imrpovement of effective equipment for the above mentioned pollution control purpose has been keenly required, and this trend is most severe in the field of automotive industries.

In this respect, there have untiringly been proposed a variety of approaches for coping with this pollution control requirement by attempting to reduce to a minimum the noxious exhaust compositions, such as carbon monoxide CO, hydrocarbons HC and nitrogen oxides $NO_x$, in the exhaust gases from the internal combustion engine in a wide range of engine operation. In general, however, these approaches tend to involve the following concomitant problems, which are complicatedly related with each other and thus, difficult to put in practice.

Referring now to FIG. 1, which is a graphical representation obtained from test runs on a horizontal road showing the relation of CO, HC and $NO_x$ produced in the engine and emitted during operation with respect to given air-fuel ratios in a gasoline engine. Nitrogen oxides $NO_x$ among other noxious exhaust compositions are as known produced at a maximum during combustion in the engine when the mixture of air and fuel supplied to the combustion chambers of the engine lies in close proximity to a theoretical air fuel ratio. As shown in FIG. 1, the production of $NO_x$ in the engine tends to reduce from its peak point, which is at the air fuel ratio of 16.5, with both richer and leaner air-fuel mixtures, and this tendency of $NO_x$ reduction occurs more sharply when the mixtures become richer (left range as viewed in FIG. 1) than when the mixtures become leaner (right range in FIG. 1).

In this respect, it is technically possible to reduce the generation of $NO_x$ by alternatively applying a richer or leaner mixture than this peak point of 16.5 to the engine combustion chambers. With respect to other noxious exhaust compositions such as carbon monoxide CO and hydrocarbons HC, it is apparent from the graph of FIG. 1 that such exhaust compositions can be reduced in formation with the use of a lean air-fuel mixture. However, in the case that such noxious exhaust compositions remaining uncombusted in the engine exhaust gases are attempted to be removed by introducing the exhaust gases into the exhaust system of the engine (such as an exhaust pipe, or a thermal reactor) for secondary combustion purpose, if the content of such compositions, especially carbon monoxide, in the exhaust gases, remains small, and if the exhaust gases are at a low temperature, there hardly occurs such secondary combustion reaction, thus it is impossible to have such exhaust gases purified completely through secondary combustion. Consequently, in an attempt to maintain the total emission into atmosphere of all such compositions as $NO_x$, CO and HC at a minimum by applying the secondary combustion reaction, a rich air-fuel mixture is preferred, only by neglecting fuel economy. However, this is not practical.

Also, it is well known that a rich air-fuel mixture can be combusted more stably than a lean one in the engine combustion chambers, and therefore, as indicated by a dash-and-dot curve Pe in FIG. 1, there is obtained a higher mean effective pressure (i.e., a more engine output) from the combustion of a rich mixture. On the other hand, with the use of a rich mixture, there are greater quantities of CO and HC formed in the combustion. In contrast, with the use of a lean mixture, the quantities of CO and HC are less, but a considerable reduction in the mean effective pressure of the engine results.

In consideration of the above stated facts involved with concomitant problems to be met, there has been proposed a method wherein an optional half of the engine cylinders is charged with a lean air-fuel mixture, while the other half of the cylinders is charged with a rich mixture and spark-ignited in following alternate manner; a thick mixture charged cylinder — a thin mixture charged cylinder, — a thick mixture charged cylinder . . . , thus maintaining the generation of $NO_x$ at a minimum, thereafter collectively introducing the exhaust gases from such engine cylinders to a thermal reactor to be further combusted therein by using exhaust gas heat accumulated in the exhaust system for secondary combustion of such exhaust compositions in the exhaust gases.

FIG. 2 is a graphical representation based on a series of field tests using a passenger car having a six-cylinder gasoline engine equipped with a thermal reactor for the purpose of oxidizing or removing CO and HC from the engine exhaust gases, in which the vehicle speed is plotted on the abscissa and the CO concentrations in the exhaust gases from the engine cylinders are plotted on the ordinate. The exhaust temperatures and concentration values of mixtures fed into the engine cylinders, are plotted on the ordinate respectively, thus mutual relationships of such factors as further described hereinafter are shown.

In FIG. 2, the curve A—A indicates threshold values of CO concentrations, i.e., critical values of CO removable through secondary combustion of CO where higher CO concentrations than the values existing in the range above the curve A—A are subjected combustion, which curve slopes down with the increase of vehicle speed.

This inclination is due to the exhaust temperature rising with the increase of vehicle speed or engine output speed. The curve B—B represents CO concentration in the exhaust gases from the engine cylinders to which a lean mixture (of about 20 in terms of air fuel ratio) is charged, and which curve is relatively independent of the vehicle speed and is below the curve A—A. Consequently, since the exhaust gases from the engine cylinders charged with a lean mixture are not subjected to secondary combustion in the reactor, it is necessary to make up a certain volume of CO to that body exhaust gases and thus having this low CO concentration in the reactor increased, i.e., raised to the range higher than the curve A—A so that it can be removed, and this makeup of CO is performed by directing the exhaust gases from the engine cylinders charged with a rich mixture. The curve C—C represents CO concentration in the exhaust gases from the engine cylinders to which charged is a rich mixture predetermined for the above stated make up purpose. Also, this curve C—C represents a tendency of the mixture concentration to be charged to the specified engine cylinder. The curve D—D represents the temperature of a thermal reactor.

As is apparent from the description above, in the method where secondary combustion is performed by using the rich air-fuel mixture, it is entirely simple to control the air fuel ratio of the lean mixture, while the air fuel ratio controls of the rich mixture is difficult for the reason that such controls should be made in due consideration of load conditions of the engine which vary with various factors. In this respect, there arise such drawbacks that the above stated arrangement is difficult and intricate in practice by using the conventional carburetor, or even by using the known electronic type fuel injection control means, because such control means require the installation of individual control systems therefor.

According to FIG. 2, the temperature of the thermal reactor reaches 800° C or higher with a vehicle speed of 60 km/h or more, and exceeds 900° C with a vehicle speed of 120 km/h. The CO concentration in the engine exhaust from the engine cylinders fed with a rich mixture is about 2% at the vehicle speed of about 60 km/h, which corresponds to the value of about 14 in terms of air fuel ratio and lies in the range of relatively rich mixture in close proximity to the theoretical air fuel ratio. At a higher vehicle speed, the curve C—C approaches the curve B—B, reaching the peak point of $NO_x$ production with the vehicle speed at 70 km/h. Such high $NO_x$ formation is indeed undesirable in view of air-pollution abatement, since such a vehicle speed is within the range if normal running speeds. When the vehicle speed increases further, the rich mixture is caused to be leaner, thus resulting in insufficiency in the engine output in the intermediate and high load ranges of the engine. In order to cope with the above stated problem, if the rich mixture is caused to be richer than the values corresponding to CO concentration of the curve C—C at the vehicle speeds of 60 km/h or higher, an extremely high CO content in the exhaust gases exhausted from the engine cylinders charged with the rich mixture, and consequently, a high temperature is produced as this CO content reacts rapidly with a surplus quantity of overheated oxygen within the reactor, which also causes HC contents to be combusted and produce a further temperature rise of the exhaust gases, and finally causing an accidental temperature rise of the reactor per se. In view of the fact that the thermal reactor and an exhaust system is preferably made of a metal of low grade having a high heat resistance, i.e., 800° C or so.

For the reasons stated above, it should be pointed out that the proposed method of compatible combustion of lean and rich mixtures charged into the engine cylinders is preferred only in the range of low engine loads.

In this respect, it would be advantageous if an improved and useful method and apparatus therefor are provided to overcome the above described concomitant problems. This invention consists of the provision of a method and an apparatus therefor wherein a rich mixture is made lean at vehicle speeds of, for instance, 60 km/h or higher, while a thin mixture is made richer, thus controlling both the lean and the rich mixture toward the richer ratio of a mixture than the theoretical air fuel ratio.

Referring still to FIG. 2, the curves of $C—C_1—E_1—E_2$ and $B—B_1—E_1—E_2$ indicate the effects of air fuel ratio controls on the both parts of a lean mixture and a rich mixture according to this invention, respectively. In such arrangement, since secondary air is no longer supplied for the oxidation of such exhaust compositions as CO and HC of the engine exhaust gases, it is arranged to compensate such secondary air into the thermal reactor. Seconday air to be made up in such arrangement is kept at a relatively low temperature, and it does not react as rapidly as excess air in the exhaust gases, and consequently, there takes place a relatively slow subsequent combustion reaction, thus avoiding an accidental overheating of the thermal reactor.

It is therefore a primary object of this invention to provide an improved method of and system for controlling air fuel ratio of an internal combustion engine wherein a thin air-fuel mixture and a thick air-fuel mixture are alternately fed to the engine cylinders for optimalizing the rates of noxious exhaust compositions for secondary combustion in a thermal reactor in a wide range of engine operation.

It is another object of this invention to provide an improved method of and system for controlling air fuel ratio of an engine whereby such air fuel ratio controls may be readily and reliably performed.

It is still another object of this invention to provide an improved method of and system for controlling air fuel ratio whereby the formation of $NO_x$ is kept at a minimum.

It is a further object of this invention to provide an improved method of and system for controlling air fuel ratio whereby the engine output power loss is kept at a minimum.

It is a still further object of this invention to provide an improved method of and system for controlling air fuel ratio whereby CO and HC contents in the exhaust gases from the engine cylinders fed with a thick mixture can be readily oxidized to innoxious compositions by using high temperature oxygen contained in the exhaust gases from the engine cylinders fed with a thin mixture.

It is a further object of this invention to provide an improved method of and system for controlling air fuel ratio wherein the controlled compatible use of a thin mixture and a thick mixture to be fed in the engine cylinders results in advantageous fuel economy of the engine.

The foregoing objects, characteristics, principle, and details of the present invention, as well as further objects and advantages thereof, will become apparent from the following detailed description with respect to preferred embodiments of the invention when read in conjunction with the accompanying drawings, in which.

Figure 1:
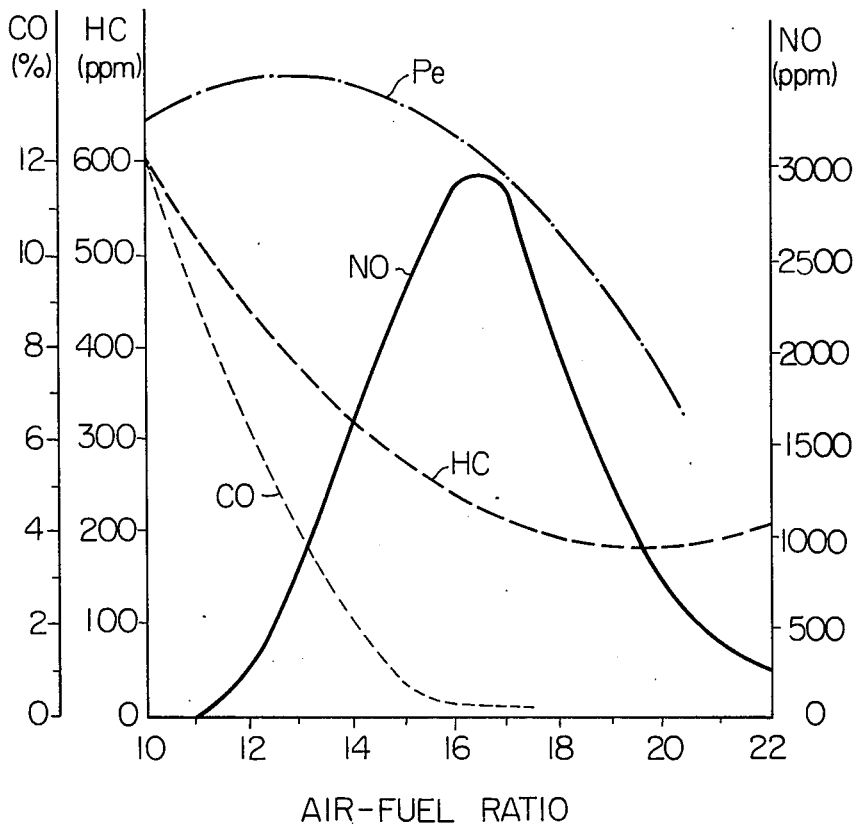
FIG. 1 is a graphical representation showing the quantitative relationships of the exhaust compositions with respect to air fuel ratio of an internal combustion engine.
Figure 2:
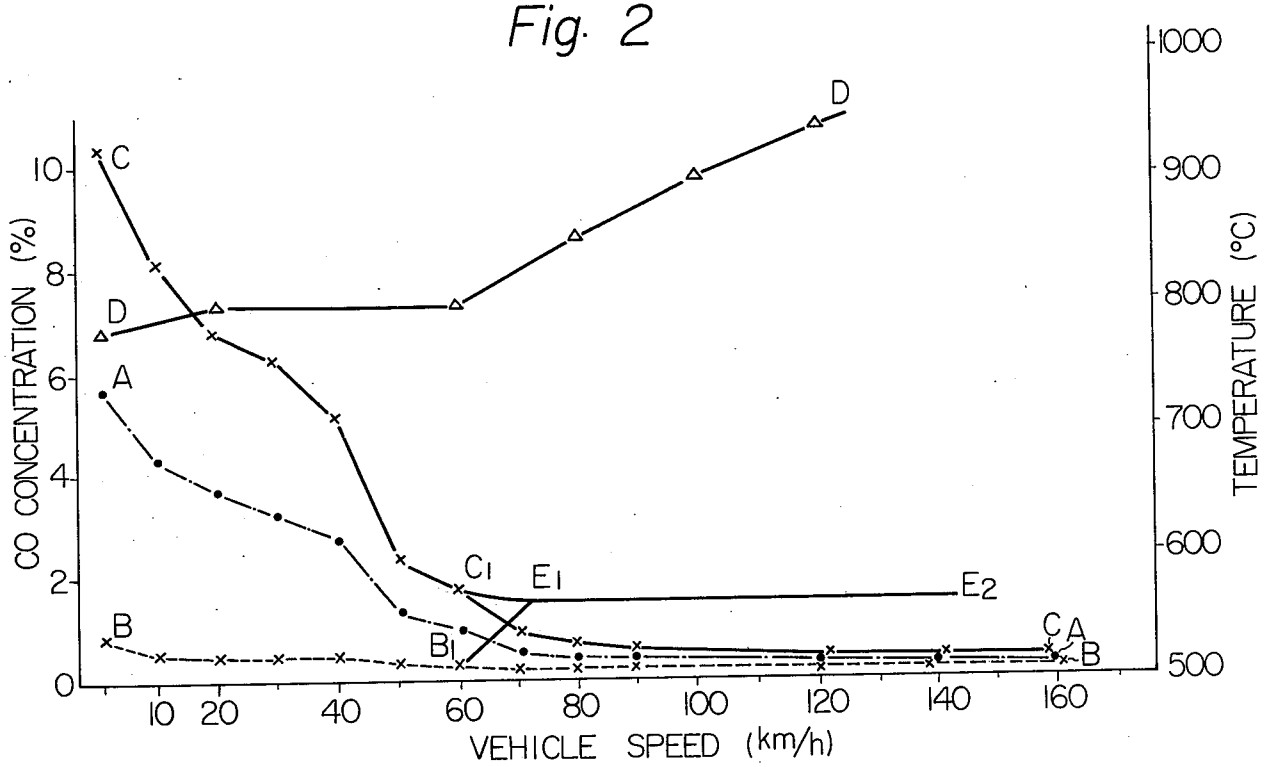
FIG. 2 is a graphical representation showing the production of carbon monoxide CO with lean and rich mixtures being charged to the engine cylinders with respect to vehicle speed.
Figure 3:
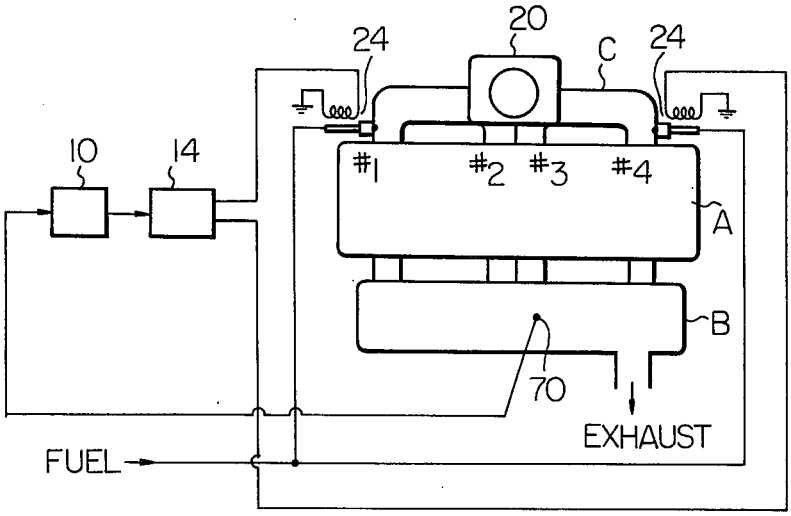
FIGS. 3, 4 and 5A are diagrammatic views of embodiments of an air fuel ratio control system according to this invention.

Referring first to FIG. 3, there is shown a first embodiment of an air fuel ratio control system according to this invention. In this embodiment, a four-cylinder internal combustion engine A comprises a thermal reactor B, an air intake manifold C, and a carburetor 20. Preferably, the carburetor 20 is so arranged that it meters liquid fuel proportional to engine load with a higher air fuel ratio or a leaner air-fuel mixture. Also, there are provided two fuel injectors 24 to two engine cylinders (No. 1 and 4 cylinders in FIG. 3), which may be of the conventional type applied to a fuel injection internal combustion engine, and being of such a construction, that they are operable in response to applied pulse signals. A function generator 10 generates predetermined functional signals corresponding to the contour of the curve C—C in FIG. 2 in accordance with load signals of the engine (e.g., signals representing engine speed and intake vacuum) or signals representing engine loads (e.g., exhaust temperature signals from a thermosensor 70). The function generator may be of any conventional type, for instance, may consist of several potentionmeters as disclosed in U.S. Pat. No. 2,980,090, which generates desired functions by varying values of resistances in dependence of engine variables. There is provided a pulse generator 14 generating pulse signals having a pulse width according to the output of the function generator 10, and these pulses are applied to the above mentioned fuel injectors 24 to increase the fuel to the No. 1 and 4 cylinders. In other words, this fuel make-up operation is performed in accordance with the contour of the curve C—C in FIG. 2, and thus the CO concentration is controlled to a desired point. In this case, it was found appropriate to control the increase of fuel to have the CO concentration variation lie in the range somewhat above the curve C—C, from the viewpoint of either fuel economy or assurance of the purification reaction of the noxious exhaust compositions.

Figure 4:
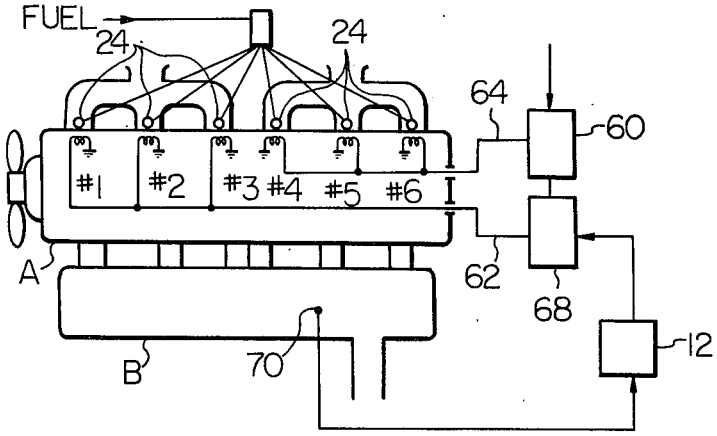

Referring now to FIG. 4, there is shown a second embodiment of an air fuel ratio control system according to this invention. In this embodiment, a six-cylinder internal combustion engine is equipped with a plurality of solenoid controlled fuel injectors 24 installed at each of the engine cylinders, and a fuel injection controller 60 which is of conventional construction, except that the fuel injectors provided at the engine cylinders No. 1 through 3 are supplied with pulse signals through a conduit 62, while the fuel injectors provided at the cylinders No. 4 through 6 are supplied with pulse signals through a conduit 64, the latter ones having a width providing a lean mixture into the individual engine cylinders. In this arrangement, there are incorporated a function generator 12, and a pulse generator 68 in the circuit 62, the pulse generator 68 being adapted to convert the pulse width of the pulse from the fuel injection controller 60 in accordance with the output of the function generator 12. Consequently, the fuel injected and accordingly the mixture to be charged to the No. 1 through 3 engine cylinders are duly controlled along the contour of the curve C—C representing CO concentration as stated hereinbefore.

Figure 5A:
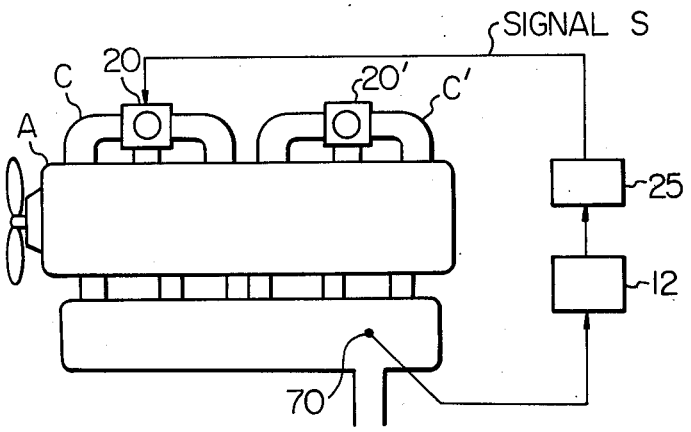

FIG. 5A illustrates a third embodiment of an air fuel ratio control system of this invention. In this embodiment, a six-cylinder engine is equipped with two separate intake manifolds C, C′ introducing separately air-fuel mixtures to first three engine cylinders and to second three engine cylinders, respectively, and independent carburetors 20, 20′ disposed one on each intake manifold. Each of the carburetors is so arranged that it may provide the individual half of the engine cylinders with a specified mixture.

Figure 5B:
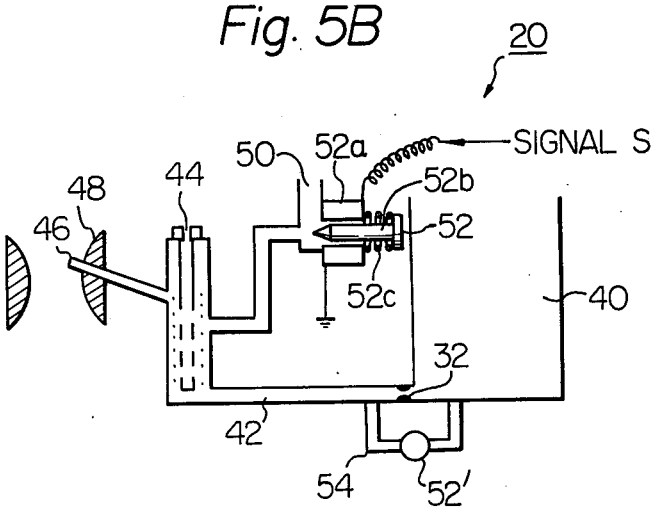
FIG. 5B is a diagrammatic view of an embodimentof a carburetor arrangement used in the air fuel ratio control system in FIG. 5A.

In FIG. 5B, there is shown an embodiment of a carburetor 20 capable to form the lean mixture to be fed to the engine cylinders. This carburetor comprises a fuel reservoir 40, a main jet passage 42, an air bleed 44, a main nozzle 46, and a second air bleed 50 installed in a passage of conventional construction leading to a venturi throat 48. This second air bleed 50 is adapted to introduce secondary air to the passage to reduce the fuel concentration of an air-fuel mixture. Furthermore, this carburetor 20 is provided with a solenoid valve 52 in the second air bleed. This solenoid valve 52 comprises a coil **52*a*, a needle valve head 52*b* working as the core of the solenoid valve, and a spring 52*c* urging the needle valve head 52*b* to open the air bleed. This arrangement coupled with the air fuel ratio control system shown in FIG. 5A, there are provided a function generator 12, and an amplifier 25 adapted to amplify the functional signals from the generator 12 to transmit an operating signal S to the coil 52*a*** of the solenoid valve, thus throttling or closing the solenoid valve.

Consequently, the magnitude of the operating signal S varies in accordance with the contour of the curve C—C of the CO concentration, thus energizing the solenoid coil **52*a* thereby to cause the needle valve head 52*b* to move toward a closing position, and consequently, the air bleed 50 is caused to be restricted further as the vehicle speed is reduced to make richer the air-fuel mixture to be fed to the first half of engine cylinders, so that the CO concentration in the engine exhaust gases may follow the aspects of the curve $C—C_1—E_1—E_2$in FIG. 2.**

Alternatively, the fuel concentration of the air-fuel mixture can be reduced by restricting the main jet passage 42. In such arrangement of the carburetor, there is provided a bypass 54 bypassing a restrictor 32 in the main jet passage 42. A solenoid valve 52′ in the bypass 54 is throttled or closed in response to the operating signal S from the amplifier 25.

Figure 6:
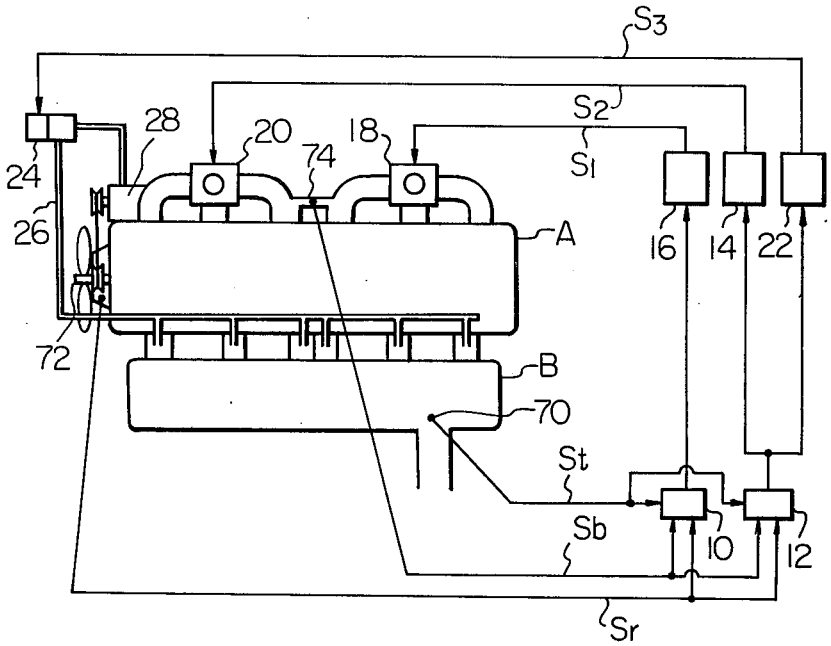
FIG. 6 is general diagrammatic view of a fourth embodiment of an air fuel ratio control system according to this invention.

FIG. 6 shows a fourth embodiment of an air fuel ratio control system according to this invention. In this embodiment, a six-cylinder spark-ignition internal combustion engine A having a thermal reactor B is equipped with an air-fuel ratio control system which comprises in combination two carburetors 18, 20, 18 being adapted to supply a rich mixture and the other 20 adapted to supply a lean mixture two function generators 10, 12 adapted to independently produce functional signals to actuate control means of a construction described hereinafter incorporated in the above mentioned carburetors, two amplification controllers 14, 16, and a reference amplifier 22 in circuit with one of the function generators and an independent solenoid valve 24 for supplying secondary combustion air to the thermal reactor B. A sensor 72 senses engine speed and a sensor 74 intake manifold vacuum. The carburetor 18 is adapted to form and supply a rich mixture to a first half group (three) of the engine cylinders, while the other carburetor 20 is adapted to form and supply a lean mixture to a second half group (three) of the engine cylinders. The function generators 10, 12 generate at their outputs function signals following contours of the curves $C—C_1—E_1—E_2$ and $B—B_1—E_1—E_1—E_2$ in FIG. 2, respectively, in accordance with engine load signals delivered to their inputs such as, for instance, engine speed signal Sr from sensor 72 and intake vacuum signal from sensor 74 Sv. These function signals may be combined in such a manner as to obtain an optimum air-fuel ratio with such engine operating factors or variables as exhaust temperature signal St from sensor 70 and the like as a parameter. Each of amplifiers 14, 16 is connected in series to one of the function generators 10, 12, respectively, and further to the individual control means installed in the carburetors. These amplifiers are adapted to form operating signals $S_1$ and $S_2$ by amplifying the above mentioned function signals. The operating signals $S_1$ and $S_2$ are converted by the amplification controllers to the form of pulse signals having a width according to the input function signals from the function generators.

The operating signals $S_1$ and $S_2$ are transmitted to the control means in the carburetors 18, 20, respectively, thereby to obtain specified lean and rich mixtures. The reference amplifier 22 has its input connected with the function generator 12.

There is further provided a thermal reactor assembly for effecting secondary combustion of the unburned exhaust compositions from the engine cylinders, which comprises the thermal reactor B, the solenoid valve 24, an air pump 26 driven by the engine, and a secondary air supply line 26. Since the solenoid valve is electrically connected to the reference amplifier 22, it is actuated upon receipt of the signal $S_3$ from the reference amplifier 22 to open a port to the secondary air supply line, thus supplying secondary combustion air to the thermal reactor B.

Figure 7:
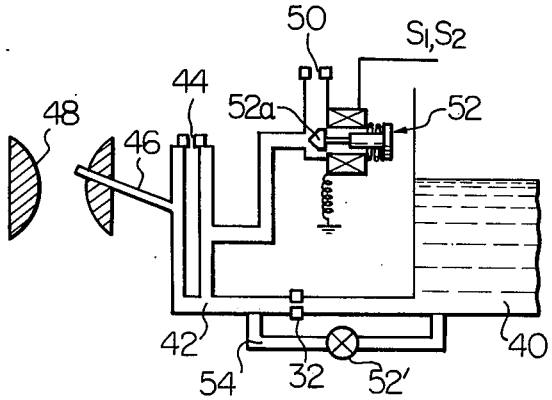
FIG. 7 is a diagrammatic view of an example of a carburetor for adjusting the air fuel ratio according to this invention.

Referring now to FIG. 7, there is shown a carburetor incorporating the above mentioned control means which functions as an air-fuel ratio adjusting means according to this invention, wherein there are provided a fuel reservoir 40, a main jet passage 42, an air bleed 44, a main nozzle 46, a second air bleed 50 leading to a venturi throat 48. The concentration of fuel in an air-fuel mixture is reduced to a desired extent by introducing air through the second air bleed 50. Also, as shown in FIG. 7, there is provided a solenoid valve 52 in the second air bleed 50, to which solenoid valve the above mentioned signals $S_1$ and $S_2$ are supplied to control the opening degree of the valve 52 to regulate the passage area of the secondary air bleed, thus obtaining a desired fuel concentration in the mixture to be fed to the engine cylinders.

As fully described hereinabove, control of air-fuel ratio of the mixture to be charged to the engine cylinders can be performed by using the carburetors of conventional construction respectively installed in one half of engine cylinders to supply a desired richness of the mixture.

Such controls of the mixture concentration can also be attained by throttling of the main jet passage 42. For such purpose, there is provided a bypass 54 bypassing an orifice 32 in the main jet passage 42, and further provided is a solenoid valve 52' in this bypass 54, the solenoid valve being actuated in response to the operating signals $S_1$ and $S_2$.

In the case that the engine is equipped with a known electronic type fuel injection system, the control circuits therefor are readily arrangeable so that the objects of this invention can be fully met.

As fully described hereinbefore, this invention provides an improved air fuel ratio control system for use with the internal combustion engine and can provide such advantageous features summarized as follows, i.e., (1) formation of $NO_x$ can be substantially lessened, (2) loss of engine output can be maintained at a minimum, (3) CO and HC contents from an engine cylinder charged with a thick mixture can be readily oxidized to innoxious compositions by using high temperature oxygen contained to a great extent in the exhaust gases from a cylinder charged with a lean mixture, and (4) controlled compatible use of a lean mixture and a rich mixture affords advantageous fuel economy.

Although detailed descriptions have been made exclusively on the foregoing typical embodiments of this invention, it should be understood, as indicated hereinbefore, that the preferred embodiments as described and shown herein do not mean in any way limitations of this invention, but on the contrary, many changes, variations and modifications with respect to the construction and arrangement in practice thereof may further be derived by those skilled in the art to which the present invention pertains, whereby the advantageous characteristics of this invention may be realized without departing from the spirit and scope of the invention as set forth hereunto in the appended claims.

What is claimed is:

1. A method of reducing harmful components contained in exhaust gases from an internal combustion engine having at least two sequentially operative combustion chambers and a device to oxidize the hydrocarbon and cabon monoxide constituents of the exhaust gases, comprising the steps of sensing an engine load, setting a predetermined near stoichiometric air/fuel ratio of the mixture to be delivered to the engine, delivering to one of said combustion chambers a lean mixture which is the leanest one at which stable combustion in the combustion chamber is maintained and which is kept substantially constant independently of variation in the engine load, presetting an air/fuel ratio of the mixture variable in dependence on the engine load, at which oxidization of carbon monoxides in the oxidizing device takes place, delivering to the other of said combustion chambers a rich mixture which is substantially richer than said preset air/fuel ratio and is variable in dependence on variation in the engine load, said rich mixture being leaner than said near stoichiometric ratio when the engine load exceeds a predetermined medium level, delivering to all the combustion chambers an air/fuel mixture, the air/fuel ratio of which is substantially equal to said near stoichiometric ratio substantially when the engine load exceeds said predetermined medium level, and delivering additional air into the engine exhaust gases substantially when the air/fuel ratio of the rich mixture reaches said near stoichiometric level.

2. A method according to claim 1, in which the air/fuel ratio of the lean mixture is 18/1 to 20/1.

3. A method of reducing harmful components contained in the exhaust gases from an internal combustion engine having at least two sequentially operative combustion chambers and a device to oxidize the hydrocarbon and carbon monoxide constituents of the exhaust gases, comprising the steps of sensing an engine load, setting a predetermined near stoichiometric air/fuel ratio of the mixture to be delivered to the engine, producing a first electric function signal representative of the air/fuel ratio of a lean mixture which is the leanest one at which stable combustion in the combustion chambers is maintained and which is kept substantially constant independently of variation in the engine load, delivering the lean mixture to one of said combustion chambers in accordance with said first function signal, presetting an air/fuel ratio of the mixture variable in dependence on the engine load, at which oxidization of carbon monoxide in the oxidizing device takes place, producing a second electric function signal representative of the air/fuel ratio of a rich mixture variable in dependence on variation in the engine load, which is richer than said preset air/fuel ratio and which is leaner than said near stoichiometric ratio at a predetermined medium level of engine load, delivering the rich mixture to the other of said combustion chambers in accordance with said second function signal, producing a third electric function signal representative substantially of said near stoichiometric ratio when the sensed engine load exceeds said predetermined medium level, delivering the near-stoichiometric mixture to both said combustion chambers in accordance with said third function signal, and delivering additional air into the exhaust gases from the combustion chambers substantially when the third functions signal is produced.

4. A system for reducing harmful components contained in the exhaust gases from an internal combustion engine having at least two sequentially operative combustion chambers and a device to oxidize the hydrocarbon and carbon monoxide constituents of the exhaust gases, comprising means sensing an engine load and producing a load signal representative of the sensed engine load, a first electric function generator having an input receiving the load signal from the sensing means and producing at an output a first function signal representative of the air/fuel ratio of a lean mixture which is the leanest one at which stable combustion in the combustion chambers is maintained, while the sensed engine load is below a predetermined medium level, means delivering the lean mixture to one of said combustion chambers in accordance with said first function signal, a second electric function generator having an input receiving the load signal from the sensing means and producing at an output a second function signal representative of the air/fuel ratio of a rich mixture variable in dependence on variation in the engine load while the sensed engine load is below said medium level, said rich mixture being substantially richer than a preset air/fuel ratio of the mixture at which oxidization of carbon monoxides in the oxidizing device takes place and being leaner than a predetermined near-stoichiometric ratio at said medium level of engine load, each of said first and said second function generators producing at the output thereof a third function signal representative of the air/fuel ratio which is substantially equal to said near-stoichiometric ratio when the engine load exceeds said predetermined medium level, means delivering to both the combustion chambers the mixture in accordance with said third function signal, and means delivering additional air into the engine exhaust gases substantially when said third function signal is produced.

5. A system according to claim 4, in which each of said delivering means comprises a pulse generator for producing a series of pulses in dependence on the function signal and an electromagnetic valve means to control the rate of air and fuel to be delivered to the corresponding combustion chamber in accordance with the pulse signals.

6. A system according to claim 4, in which said additional air delivering means comprises an electric comparator connected with the output of the second function generator for producing an air supply signal when the second function signal exceeds a reference signal representing said near-stoichiometric ratio.

* * * * *